US006966117B1

(12) United States Patent
Cannon

(10) Patent No.: US 6,966,117 B1
(45) Date of Patent: Nov. 22, 2005

(54) CARPENTERS PENCIL SHARPENER

(76) Inventor: Jeffrey C. Cannon, 3250 El Camino Real, Unit C-2, Atascadero, CA (US) 93422

( * ) Notice: Subject to any disclaimer, the term of this patent is extended or adjusted under 35 U.S.C. 154(b) by 0 days.

(21) Appl. No.: 10/851,798

(22) Filed: May 24, 2004

(51) Int. Cl.[7] ..... B43L 23/08
(52) U.S. Cl. ..... 30/451; 30/456; 30/457
(58) Field of Search ..... 30/451, 452, 456, 30/457, 453, 455, 458, 459, 460–462, 298.4; 401/50–52, 401/195; 144/28.11, 28.1–28.3, 28; D19/73, D19/35, 36, 74, 95, 99, 100

(56) References Cited

U.S. PATENT DOCUMENTS

| | | | | | |
|---|---|---|---|---|---|
| 346,356 | A * | 7/1886 | Clark | 30/453 |
| 418,870 | A * | 1/1890 | Hazlett | 30/462 |
| 458,654 | A * | 9/1891 | Brookbank | 30/452 |
| 486,470 | A * | 11/1892 | Humphries | 30/458 |
| 673,770 | A * | 5/1901 | Fortunati | 30/452 |
| 2,982,253 | A * | 5/1961 | Herbold | 30/461 |
| 4,248,283 | A * | 2/1981 | Kaye | 30/454 |
| 5,077,903 | A * | 1/1992 | Kreim | 30/451 |
| 6,092,293 | A * | 7/2000 | Donaldson | 30/457 |
| 6,237,656 | B1 * | 5/2001 | Whitehead et al. | 144/28.3 |
| 6,279,238 | B1 * | 8/2001 | Gillson | 30/456 |
| 6,338,198 | B1 * | 1/2002 | Rolls | 30/452 |
| 6,571,480 | B1 * | 6/2003 | Qiu | 30/457 |
| D477,847 | S * | 7/2003 | Gosse | D19/73 |
| 6,698,100 | B2 * | 3/2004 | Yan | 30/298.4 |
| 6,725,549 | B2 * | 4/2004 | Jebe et al. | 30/452 |
| D494,222 | S * | 8/2004 | Berry | D19/73 |
| 2003/0029046 | A1 * | 2/2003 | Belsaas | 30/457 |
| 2005/0000099 | A1 * | 1/2005 | Jebe et al. | 30/451 |

* cited by examiner

*Primary Examiner*—Allan N. Shoap
*Assistant Examiner*—Ghassem Alie
(74) *Attorney, Agent, or Firm*—Charles C. Logan, II

(57) ABSTRACT

A carpenters pencil sharpener having a body member having a T-shaped opening in its front wall. The body member has an interior pencil sharpening chamber having respective left and right upper support platforms and respective left and right lower support platforms. There are respective left and right upper ramps that extend inwardly from the T-shaped opening to the respective left and right upper support platforms. There are also respective left and right lower ramps that extend inwardly from the T-shaped opening to the respective left and right lower support platforms. A transversely extending blade member has a rearwardly extending cutting edge that extends into the interior pencil sharpening chamber. The T-shaped opening of the pencil sharpener allows a carpenters pencil to be inserted at four different 90 degree positions in order to sharpen the four different sides of the carpenters pencil.

10 Claims, 2 Drawing Sheets

CARPENTERS PENCIL SHARPENER

BACKGROUND OF THE INVENTION

The invention relates to a pencil sharpener and more specifically to a pencil sharpener for carpenters pencils. Some prior art pencil sharpener patents will now be discussed.

The Jones U.S. Pat. No. 240,520 is directed to a pencil sharpener. To sharpen the pencil, insert the end in the slot E in the case A and push it forward over the cutting-blade C, and, as it is forced forward it will raise the pressure spring D, which will let it move up the inclined bearing-surface B to the stop or end of incline, above the cutting-blade C. Then as the pencil is drawn back and down the incline bearing-surface, with the pressure spring D bearing down upon it and forcing the pencil against the cutting-blade C, it will cause the cutting blade to cut off a shaving, which will pass out of the slot F. The continuous movement of the pencil forward and backward, and at the same time turning it around in the fingers, so as to bring all of its surfaces to the cutting blade, will sharpen it to a point in the center on the same pitch as the pitch of the inclined bearing surface.

The Mead U.S. Pat. No. 716,732 is directed to a pencil sharpener having a housing and a cover with aligned apertures 2 and 5 in one of their ends. In the operation of the sharpener, the pencil is pushed inwardly through the coinciding openings 2 and 5 and between the inner recessed ends of the flanges 9 of the guide and also a suitable distance between and beyond the inner cutting edges 14 of the blades 13. The operator then reciprocates the pencil longitudinally to cut away the wood and taper the end of the lead. During such operation the end of the pencils being sharpened can be seen through the opening 6 and the cover. The shaving and lead particles may be discarded from the sharpener through the outlet opening 6.

The Davis U.S. Pat. No. 1,531,738 is directed to a pencil sharpener. It has a box with an aperture formed in its one end within which there is a cylindrical guideway passage 25. When the end 59 of pencil 60 is inserted through the guideway passage 25 of the sleeve 24, it will tend to push the finger 41 and the cutter blade 50 apart at their free forward portions and by rotating the pencil relatively to the device, the cutting edge 57 of the knife will pare the portion 59 and owing to the resilient pressure on the finger 41 and cutter 50 the paring will take place in the form of a taper.

The Rew U.S. Pat. No. 1,775,601 is directed to a pencil sharpener. It has blades 9 and 10 that are formed from resilient material and have their free ends terminating in beveled cutting edges 13 which are normally disposed in contacting engagement that are separated when a pencil is passed through the bore 6 as shown in FIG. 5 of the drawings. The strip 4 is adapted to limit the movement of the pencil in the sharpener, and when the pencil is withdrawn a cutting edge 13 cuts through the wood and the pencil lead giving it a sharpened end as illustrated in FIGS. 9 and 10 of the drawings.

The Herbold U.S. Pat. No. 2,982,253 is directed to a sharpener for carpenter pencils. In using the device a pencil is inserted in the open end of the body the desired amount and the pencil and the body are relatively reciprocated. Flexible blades will yield outwardly on the inward movement of the pencil and will sharpen the latter on the outward stroke of the pencil, the shavings falling out of the openings 14 and 16. The blade 17 will not merely cut the wood down to the lead of the pencil but the blades 15 will also sharpen the lead in a flat pointed marking edge.

The Jones U.S. Pat. No. 3,851,687 is directed to a pencil sharpener particularly adapted for use with carpenters' pencils and the like. When the pencil 20 is inserted into the channel 14, it moves the blades 22 out of the way causing them to pivot toward the wall 18 against the biasing force of a resilient biasing means disposed in the container. The biasing means comprises a compression spring 44 connected to each blade 22 adjacent the inner end of the surface 40 thereof and also appropriately connected to the wall 18.

The Gillson U.S. Pat. No. 6,256,892 is directed to a carpenter's pencil sharpener. To use, a carpenter's pencil is inserted into one of the bores 20 or 22. Razorblade 28 is pushed upwardly on the mass of the pencil and is resiliently held to said pencil by springs 32 while allowing the pencil to slide freely. When the pencil is withdrawn, cutting edge 30 engages and whittles the tip of the pencil as springs 32 keep edges 30 in firm contact with the pencil. The two bores 20 and 22 allow a user to sharpen both the long sides and the short sides of the oval profile of the pencil with one cutting edge. This patent expires in 2021. The structure of your device would not infringe any of the claims of this patent.

SUMMARY OF THE INVENTION

A carpenters pencil sharpener has been designed with a single opening in its front wall. The opening has a T-shaped configuration designed to accept the front end of the carpenters pencil in both a vertically oriented position and a horizontally oriented position. A pencil is inserted into the sharpener allowing the beveled blade to dig into the pencil casing. By pulling it out a cut is made. Three or four repetitions of this action will complete the cut on that side of the pencil. The pencil is rotated 90 degrees to sharpen each side. Each of the four sides of the pencil are sharpened in the same way. The pencil shavings are ejected through an aperture in the top wall.

DESCRIPTION OF THE PREFERRED EMBODIMENT

Figure 1:
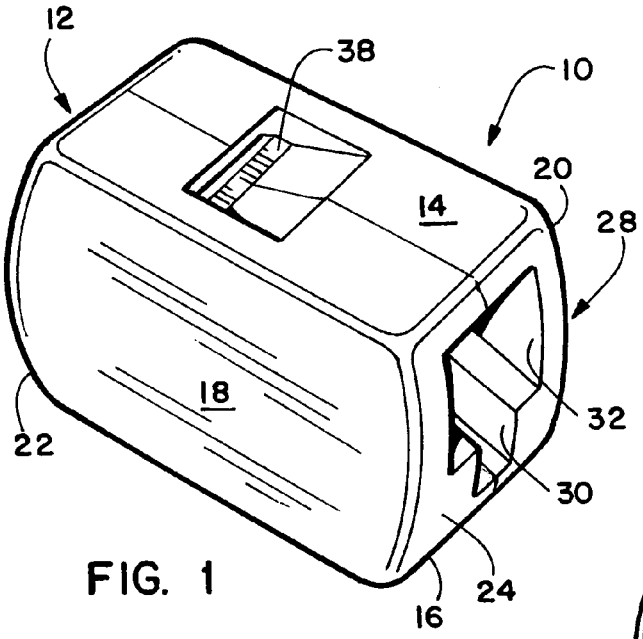
FIG. 1 is a front perspective view of the novel carpenters pencil sharpener.

The carpenter's pencil sharpener will now be described by referring to FIGS. 1–9 of the drawings. The carpenter's pencil sharpener is generally designated numeral 10. The pencil has a body member 12 having a top wall 14, a bottom wall 16, a left side wall 18, a right side wall 20, a rear wall 22 and a front wall 24 and a longitudinally extending X-axis.

In its preferred embodiment, body member 12 would be made from a left half unit 23 and a right half unit 27 that are assembled together by the use of an adhesive, by fusion, or any other state of the art method.

Figure 6:
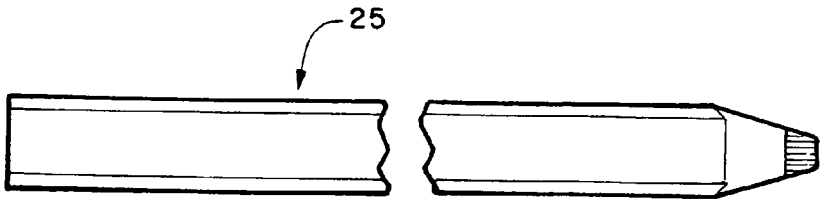
FIG. 6 is a side elevation of an unsharpened carpenters pencil.
Figure 7:
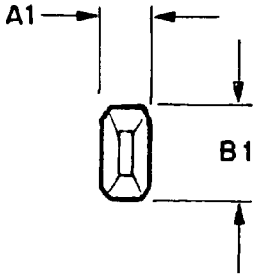
FIG. 7 is a front elevation view of a carpenters pencil.

A carpenters pencil is illustrated in FIGS. 6 and 7 and it is generally designated numeral 25. As illustrated, it is vertically oriented and it has a width A1 and a height B1.

Body member 12 has a T-shaped opening 28 formed in front wall 24. A shavings ejection port 29 is formed in top wall 14. Body member 12 would have a length in the range of 1.25–4.0 inches. It would have a height in the range of 0.75–2.50 inches and a width in the range of 0.75–2.50 inches.

T-shaped opening 28 has a lower slot portion 30 having a width W1 and a height H1. It also has an upper slot portion 32 having a width W2 and a height H2.

Figure 4:
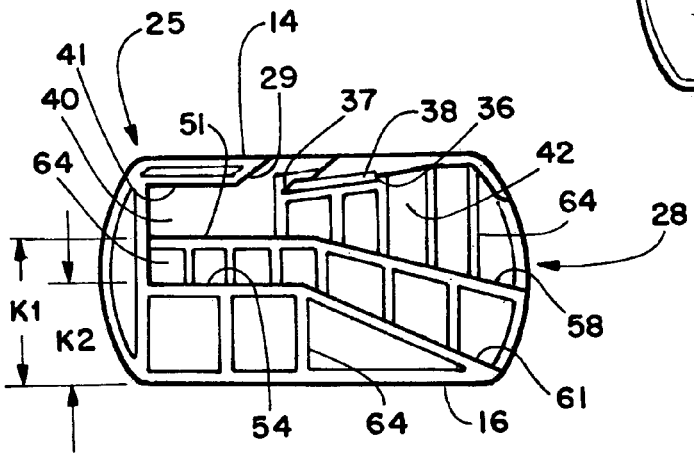
FIG. 4 is a vertical cross section view taken along lines 4—4 of FIG. 3.
Figure 5:
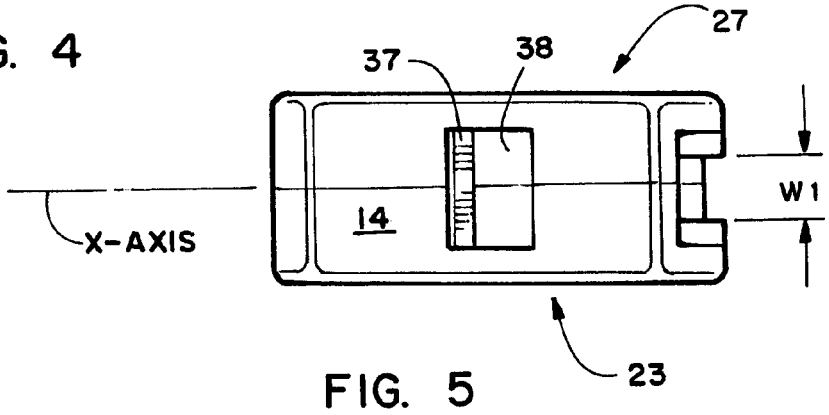
FIG. 5 is a top plan view of the carpenters pencil sharpener.

Right half unit 27 is illustrated in FIG. 4 and the left half unit would be identical with a reversed image. Only the structure of the right half unit will be described but it is to be understood that the left half unit has the same structural elements.

A pencil sharpening chamber 40 is located in body member 12 and it is defined by an interior top wall surface 41, an interior left wall surface, an interior right wall surface, an interior rear wall surface and an interior bottom wall surface. Pencil sharpening chamber 40 is in communication with T-shaped opening 28. Blade member 38 has a front edge 36 and a rearwardly extending cutting edge 37. Blade member 38 is supported in any convenient manner. A pencil insertion/extraction chamber 42 is located between pencil sharpening chamber 40 and T-shaped opening 28.

Figure 3:
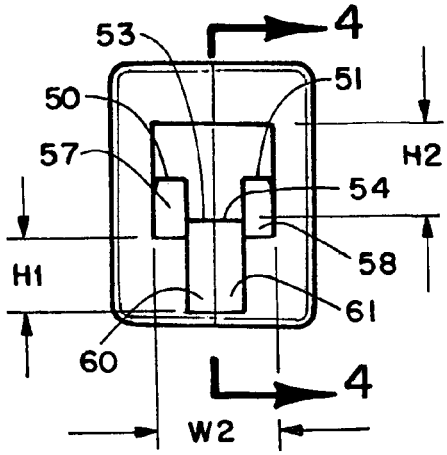
FIG. 3 is a front elevation view of the carpenters pencil sharpener.
Figure 2:
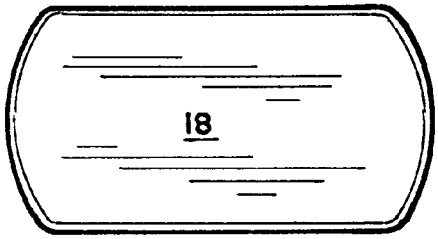
FIG. 2 is a side elevation view of the carpenters pencil sharpener.

The interior of body member 12 is best understood by referring to FIGS. 3 and 4 of the drawings. There is an upper left support platform 50 and an upper right support platform 51 in pencil sharpening chamber 40. They each have a height K1 measured from bottom wall 16. These upper support platforms extend inwardly from their respective left and right wall members 18 and 20. Lower left and right support platforms 53 and 54 also extend inwardly from their respective side walls 18 and 20. They each have a height K2 measured from bottom wall 16. A left upper ramp 57 and a right upper ramp 58 also extend inwardly from the respective left and right side walls. A left lower ramp 60 and a right lower ramp 61 extend inwardly from the respective side walls. Various ribs 64 extend inwardly from the respective side walls to give strength to the structure.

Figure 8:
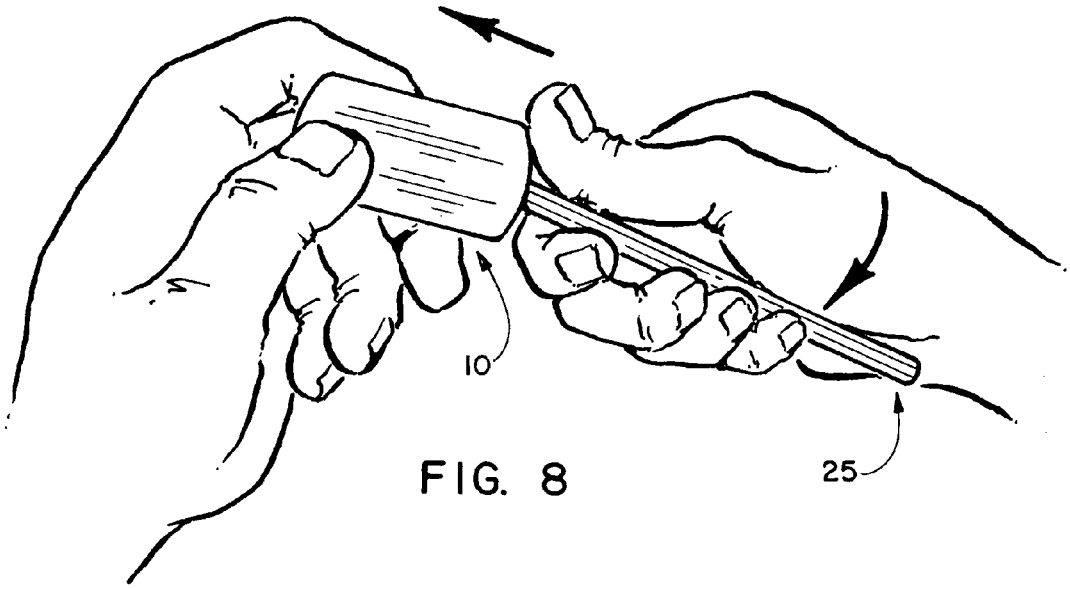
FIG. 8 is a perspective view illustrating the manner in which a carpenters pencil is inserted into the sharpener.
Figure 9:
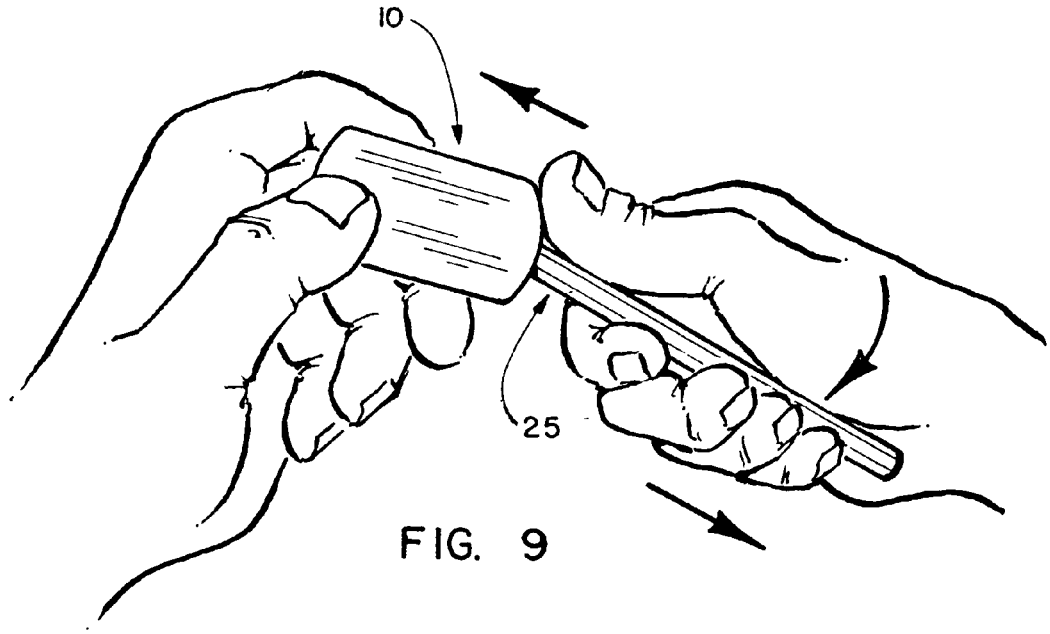
FIG. 9 is a perspective view illustrating the manner in which the carpenters pencil is withdrawn from the sharpener during the act of sharpening the pencil.

FIGS. 8 and 9 show the manner in which the carpenters pencil sharpener is used. It would normally be gripped in the left hand of the user and the right hand would insert the front end of the carpenters pencil into the T-shaped opening 28 and into the rear end of pencil sharpening chamber 40. If the pencil 25 is in its vertically oriented position, it would rest on the respective left and right lower support platforms. Next the right hand would pivot the carpenters pencil downwardly onto the lower left and right ramp members until its front end contacts inner top wall surface 41 thereby controlling the depth of cut and regulating the amount of material removed and the force required to draw the pencil across the blade. Withdraw of the pencil from the sharpener which would draw the top edge of the pencil across blade 37 for a sharpening stroke. Two or three strokes are normally enough to sharpen an edge of the pencil. The upper ramps 51, 58 and lower ramps 60, 61 are angled such that contact with the blade is predetermined to provide the proper amount of material removal to expose pencil lead in a rectangular shape. The pencil would then be rotated 90 degrees and inserted back into the sharpener and at this time it would rest on the respective upper support platforms 50 and 51. The pencil is then pivoted downwardly to the right to the respective left and right upper ramps and withdrawn therefrom pulling the top edge of the pencil against the cutting edge 37 of blade member 38. A couple more strokes would be performed until that side of the pencil is properly sharpened. The remaining two edges would be sharpened by consecutively rotating 90 degrees and sharpening that particular edge as previously described.

What is claimed:

1. A carpenters pencil sharpener comprising:

a body member having a front wall, a rear wall, a left side wall, a right side wall, a top wall, a bottom wall and a longitudinally extending X-axis; only a T-shaped opening is formed in said front wall;

said body member has an interior pencil sharpening chamber defined by an interior top wall surface, an interior left wall surface, an interior right wall surface, an interior rear wall surface and an interior bottom wall surface; said interior pencil sharpening chamber being in communication with said T-shaped opening;

a blade member having a substantially linear front end and a rearwardly extending cutting edge; said substantially linear front end being oriented substantially perpendicular to said X-axis; said blade member being rigidly supported in said body member with said cutting edge positioned in said pencil sharpening chamber; and said body member also having an interior pencil insertion/retraction chamber that is positioned between said interior pencil sharpening chamber and said T-shaped opening in said front wall of said body member whereby a carpenters pencil that has a rectangular cross section can be axially inserted into said T-shaped opening of said sharpener at four different 90 degree positions and axially retracted in order to sharpen the four different sides of said carpenters pencil.

2. A sharpener as recited in claim 1 further comprising a shavings ejection port in said top wall of said body member.

3. A sharpener as recited in claim 1 wherein said body member is formed from a left half unit and a right half unit.

4. A sharpener as recited in claim 3 wherein said left and right half units are molded from plastic material.

5. A sharpener as recited in claim 1 wherein said T-shaped opening has a vertically oriented lower slot portion having a width (W1) that is wide enough to freely receive the width of a vertically oriented carpenters pencil and too narrow to receive the height dimension of a vertically oriented carpenter's pencil when it is rotated 90 degrees.

6. A sharpener as recited in claim 5 wherein said T-shaped opening has a horizontally oriented upper slot portion having a width (W2) that is wide enough to freely receive the height dimension of a vertically oriented carpenters pencil when it is rotated 90 degrees.

7. A sharpener as recited in claim 1 further comprising an upper left support platform in said interior pencil sharpening chamber extending inwardly from said interior left wall surface and an upper right support platform in said interior pencil sharpening chamber extending inwardly from said interior right wall surface; said left and right upper support platform have a height (K1) and they are laterally separated from each other.

8. A sharpener as recited in claim 7 further comprising a lower left support platform in said interior pencil sharpening chamber extending inwardly from said interior left wall surface and a lower right support platform in said interior pencil sharpening chamber extending inwardly from said interior right wall surface; said left and right lower support platforms have a height (K2) and (K1) is greater than (K2); said left and right lower support platform extend inwardly a sufficient distance so that they contact each other.

9. A sharpener as recited in claim 8 further comprising a left upper ramp and a right upper ramp extending from said T-shaped opening to said respective left and right upper support platforms.

10. A sharpener as recited in claim 9 further comprising a left lower ramp and a right lower ramp extending inwardly from said T-shaped opening to said respective left and right lower support platforms.

* * * * *